US005256623A

United States Patent [19]

Fukuda

[11] Patent Number: 5,256,623

[45] Date of Patent: Oct. 26, 1993

[54] THERMAL SUBLIMABLE DYE TRANSFER IMAGE RECEIVING SHEET

[75] Inventor: Kozo Fukuda, Tokyo, Japan

[73] Assignee: Nisshinbo Industries, Inc., Tokyo, Japan

[21] Appl. No.: 803,952

[22] Filed: Dec. 9, 1991

[30] Foreign Application Priority Data

Dec. 12, 1990 [JP] Japan ..... 2-409860

[51] Int. Cl.[5] ..... B41M 5/035; B41M 5/38

[52] U.S. Cl. ..... 503/227; 428/195; 428/206; 428/231; 428/913; 428/914

[58] Field of Search ..... 8/471; 428/195, 331, 428/913, 914; 503/227

[56] References Cited

U.S. PATENT DOCUMENTS 4,757,047 7/1988 Kosaka ..... 503/227

5,106,818 4/1992 Ashida ..... 503/227

*Primary Examiner*—B. Hamilton Hess

*Attorney, Agent, or Firm*—Rogers & Killeen

[57] ABSTRACT

A thermal sublimable dye transfer image receiving sheet having a flat base (a white film, an opaque film, a transparent film or a sheet formed by sticking a film and paper) and a dye receiving layer which is formed on the upper surface of the base and receives a sublimable dye, the dye receiving layer containing an organic agent for improving dye transfer density having a compatibility with the sublimable dye and an inorganic adsorbent which adsorbes the above-described dye.

5 Claims, No Drawings

THERMAL SUBLIMABLE DYE TRANSFER IMAGE RECEIVING SHEET

BACKGROUND OF THE INVENTION

1. Field of the Invention

The present invention relates to a thermal sublimable dye transfer image receiving sheet for use in thermal sublimable dye transfer recording, and, more particularly, to an image receiving sheet to which an image can be transferred at high density while exhibiting excellent performance of conserving the image quality.

2. Prior Art

Hitherto, a conventional thermal sublimable dye transfer image receiving sheet has been disclosed which is constituted by forming a dye receiving layer on the base thereof, the dye receiving layer being mainly composed of a high polymer resin made of, for example, polyester, polyvinyl chloride or polyvinyl butyral exhibiting excellent affinity with a sublimable dye. Another thermal sublimable dye transfer image receiving sheet has been disclosed which is constituted by forming a dye receiving layer which can be made by hardening a radiation hardening type oligomer or monomer.

However, although the thermal sublimable dye transfer operation by using an image receiving sheet of the type described above enables excellent reproducibility to be realized in the case of medium tone images, there arises a problem in that the dyeing facility at high density is unsatisfactory in comparison to other transfer methods, for example, a melting type thermal transfer method. Another problem takes place in that the performance of conserving the image quality against wet heat is unsatisfactory.

Therefore, a variety of methods have been disclosed to overcome the above-described problems. However, any of the conventional methods could not simultaneously realize satisfactory performance of conserving the image quality and a high density dyeing facility.

SUMMARY OF THE INVENTION

To this end, an object of the present invention is to provide a thermal sublimable dye transfer image receiving sheet capable of overcoming the above-described conventional problems, exhibiting high density dye adsorption facility and obtaining a clear image having excellent performance of conserving the image quality.

Therefore, according to one aspect of the present invention, there is provided a thermal sublimable dye transfer image receiving sheet having a dye receiving layer on the surface of a base thereof and containing an organic agent for improving dye transfer density and an inorganic adsorbent in the dye receiving layer.

That is, the inventor of the present invention has studied to overcome the above-described problems and has found that a structure in which the dye receiving layer to be layered on the surface of the base contains the organic agent for improving dye transfer density having a compatibility with the sublimable dye and the inorganic adsorbent for adsorbing the dye will enable the dye receiving layer to exhibit high density dye receiving facility and excellent performance of conserving the image quality.

Other and further objects, features and advantages of the invention will be appear more fully in the following description.

DESCRIPTION OF THE PREFERRED EMBODIMENTS

The present invention will now be described.

Since the thermal sublimable dye transfer image receiving sheet is arranged as described above, the description will be made about its base, material for the dye receiving layer, an organic agent for improving dye transfer density and an inorganic adsorbent to be contained in the dye receiving layer, and status when printing is performed by using the image receiving sheet according to the present invention.

As the base, a flat material such as a polypropylene film or a polyester film, which may be transparent or opaque, or a porous synthetic sheet or the like exhibiting excellent cushioning performance and flatness is used. Another base composed by adhering a common sheet and the above-described film to each other may be employed.

The dye receiving layer is made of a resin such as polyester, polyvinyl chloride and polyvinyl butyral capable of easily receiving the sublimable dye. The dye receiving layer is formed by a method comprising the steps of making a solution by dissolving or dispersing the above described resin and drying the solution resin after it has been applied. However, the present invention is not limited to this. As an alternative to this, the dye receiving layer may be formed by radiation-hardening an oligomer or a monomer, which is capable of easily receiving the sublimable dye.

The organic agent for improving dye transfer density to be contained in the above-described dye receiving layer is selected from organic substances which enable the dyeing facility to be improved when it is contained in the dye receiving layer and which exhibits excellent compatibility with the dye. For example, it is exemplified by a surface active agent for use in a dyeing assistant antiliaries, a dispersant, an antistatic agent or the like, or a metallic organic complex made of a fatty acid metal salt of tin, barium, zinc, cadmium or the like for use in an antidiscoloration agent, a heat stabilizer or the like, or a plasticizer or the like. In particular, the surface active agent for use in the dyeing assistant auxiliaries or the dispersant is effectively employed.

The surface active agent is exemplified by an acetylene glycol type or an acetylene alcohol type active agent shown in the following (1) to (4), or a non-ionic surface active agent such as poly (oxyethylene.oxypropylene) glycol.monoether, polyoxyethylene sorbitan fatty acid ester or the like:

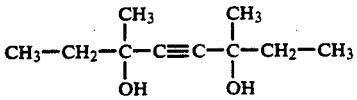

(1)

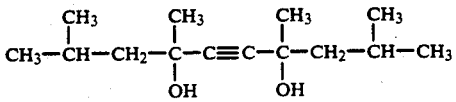

(2)

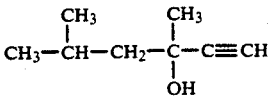

(3)

-continued

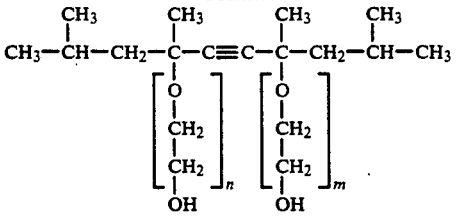

(4)

(n+m=N: additive molarity of ethylene oxide)

In the present invention a method of making the dye receiving layer containing the above-described surface active agent is not limited. Any proper method such as heating, dissolving or dispersing is selected.

Also in the present invention the content of the surface active agent it may be respectively determined in accordance with the selected substance. In general, if it is contained by a too large quantity, blocking or discoloration will take place. Furthermore, the separation between the color sheet and the image receiving sheet cannot be performed satisfactorily, causing printing to become impossible. If the same is too small, an effect of the organic agent for improving dye transfer density cannot be obtained.

The inorganic adsorbent according to the present invention is an inorganic substance which is contained in the dye receiving layer to cause the sublimable dye to be adsorbed by the inorganic substance in order to improve the performance of conserving the image quality, in particular, the performance of conserving the image quality against wet heat. It is exemplified by hydrophobic fine powder silica or pearl pigment and the like. In particular, the hydrophobic fine powder silica will cause an excellent effect to be realized. The pearl pigment is exemplified by natural mica and an inorganic type pearl pigment made from titanium oxide.

The hydrophobic fine powder silica is exemplified by a silica prepared by substituting a silanol group by an alkyl group such as a methyl group thereof. The present invention is not limited to its hydrophobic rate, particle size, the specific surface and the like. However, if the particle size of the silica powder is too large, the surface of the dye receiving layer becomes too rough, causing a risk of dot omission to arise in the obtained print. What is even worse, the glossiness will be lost. Substances exhibiting high hydrophobic rate have a tendency to give unsatisfactory dispersion, while substances having a relatively low hydrophobic rate give more satisfactory dispersion. In general, the content of the silica is made to be 0.1 to 40 parts by weight with respect to 100 parts of resin, preferably 0.5 to 20 parts by weight. If the content is too small, the effect of conserving the image quality will be lost. If the same is too large, the surface of the dye adsorbing layer becomes too rough, the glossiness will be lost and the dyeing facility becomes unsatisfactory.

Although hydrophilic fine powder silica have somewhat satisfactory effect to be obtained, the effect is inferior to that obtainable from the hydrophobic fine powder silica. A dye receiving layer in which only the organic agent for improving dye transfer density is contained and the inorganic adsorbent is not contained will causes excessive discoloration and/or migration.

As described above, the present invention is arranged in such a manner that both the organic agent for improving dye transfer density and the inorganic adsorbent are contained in the dye adsorbing layer. As a result, an image receiving sheet capable of forming an image at high density and exhibiting excellent performance of conserving the image quality can be manufactured. In particular, excellent performance of conserving the image quality can be obtained even if the ambient temperature and the humidity are considerably high. Although the reason for this has not been cleared yet, it can be considered as follows:

Dye molecules sublimated and dispersed by heat energy are received in the molecules of the dye receiving layer. In this state, the organic agent for improving dye transfer density having a compatibility with the dye in the dye receiving layer so that help dye molecules easily move in the layer the heat energy is supplied. Therefore, a larger quantity of the dye molecules can be introduced into the dye receiving layer although the energy is not increased. As a result, a dyed layer exhibiting a high density can be obtained.

However, the dye molecules which can easily move in the dyed layer as described above is likely to cause the dye receiving layer to be deteriorated in the performance of conserving the image quality, that is, to be a dye receiving layer in which discoloration and migration can easily take place.

By arranging the above-described dye receiving layer in such a manner that both the organic agent for improving dye transfer density and the inorganic adsorbent are contained therein, its performance of conserving the image quality can be improved.

As the inorganic adsorbent, it is preferable that the hydrophobic fine powder silica be selected from the fine powder silica and the pearl pigment in order to obtain the above-described effect.

The reason for the above-described effect obtainable in that the performance of conserving the image quality can be improved by the arrangement in which the inorganic adsorbent is contained with the organic agent for improving dye transfer density can be considered as follows:

The dye molecules received in the molecules in the dye receiving layer are again sublimated by heat energy with time. However, a portion of the dye molecules horizontally move in the dye receiving layer, causing migration to take place on the formed image. Furthermore, the dye molecules discharge from the dye receiving layer or move toward the base after they have vertically moved in the dye receiving layer. As a result, the discoloration will take place. In addition, the above-described movements is considered to be enhanced by water and the like. Therefore, the discoloration and migration become more critical problems at high temperature and high humidity in comparison to the room temperature and humidity.

An image printed on this dye receiving layer containing the above-described inorganic adsorbent was observed by magnifying it to several tens to hundreds times after it had been stored at high temperature and high humidity. As a result, there was irregular dyeing density, that is portions displaying a high dyeing density and other portions a low dying density. However, the irregular dyeing density was distributed uniformly. The above-described irregular dyeing density distribution was not observed in the printed image which is not stored. It is apparent that the dye has moved during the storage test. However, since the above-described movement of the molecules takes place in a microscopic manner and the density distribution is made uniformly, it cannot be observed by naked eye and thereby no practical problem takes place.

Since the above-described irregular dyeing density distribution approximates the distribution of the inorganic adsorbent dispersed in the dye receiving layer, it can be considered that the inorganic adsorbent has performance of trapping or adsorbing the dye.

As described above, the dye receiving layer containing both the organic agent for improving dye transfer density and the inorganic adsorbent causes an effect of increasing the dye density by the action of the organic agent for improving dye transfer density thereof and an effect of fixing the dye by the action of the inorganic adsorbent thereof. As a result, the performance of conserving the image quality can be improved.

EXAMPLES

Then, examples of the present invention will now be described.

EXAMPLE 1

Foamed polyprolylene sheet the thickness of which was 35 μm was sticked to one side of a coated sheet (duodecimo, 90 kg) and polypropylene sheet the thickness of which was 20 μm was sticked to the other side of the same so that a base A was obtained.

Furthermore, a white coat layer the composition of which was arranged as follows and the thickness of which was 5 μm was formed on the upper surface of the foamed polypropylene sheet layer of the above-described base A, while a reverse coat layer the composition of which was arranged as follows and the thickness of which was 7 μm was formed on the upper surface of the polypropylene sheet of the same. As a result, a sheet B was obtained.

| Composition of White Coat Layer | |
|---|---|
| Water base urethane resin (polyurethane dispersion manufactured by Bayer) | 100 parts by weight |
| Wetting agent (Nopuko SK388 manufacturd by San-Nopuko) | 1 part by weight |
| Associateive Thickener (EXP-300 manufactured by ROHM & HAAS) | 5 parts by weight |
| Hollow filler (Ropaque OP-82 manufactured by ROHM & HAAS) | 15 parts by weight |
| Fluorescent brightener | 2 parts by weight |
| Titanium dioxide | 15 parts by weight |
| Antifoaming agent | 0.3 parts by weight |
| Water | 40 parts by weight |
| Composition of Reverse Coat Layer | |
| Polyvinyl acetal resin (KX-1 manufactured by Sekisui Kagau) | 100 parts by weight |
| Water base resin (EK-1000 manufactured by Saiden Kagaku) | 100 parts by weight |
| Barium stearate | 20 parts by weight |
| IPA (Isopropyl alcohol) | 120 parts by weight |
| Water | 120 parts by weight |

A dye receiving layer the composition of which was arranged as follows was formed on the upper surface of the white coat layer of the sheet B so that an image receiving sheet 1 was obtained. The thickness of the dye receiving layer was 3 μm.

| Composition of Dye Receiving Layer | |
|---|---|
| Water base polyester resin (MD1200 manufactured by Toyo Boseki) | 200 parts by weight |
| Wetting agent | 4 parts by weight |
| Associative thickener | 10 parts by weight |
| Amino denatured silicone (KF-393 manufactured by Shin-Etsu Silicone) | 5 parts by weight |
| IPA | 300 parts by weight |
| Water | 100 parts by weight |
| Dye solving agent (acetylene glycol type surface active agent: Surfynol TG manufactured by Nisshin Kaaku) | 30 parts by weight |
| Adsorbent (hydrophobic fine powder silica: Aerosil R-972 manufactured by Nihon Aerosil) | 5 parts by weight |
| Leveling agent (Fluorad 430 manufactured by Sumitomo 3M) | 0.6 parts by weight |

The image receiving sheet thus-manufactured was used to perform printing by using a printer (Ser-cp100 manufactured by Mitsubishi Electric) available from the market. Then, the density of the black solid portion was measured by a density meter (DM-400 manufactured by Dainippon Screen). As a result, a density of 2.20 was obtained.

Further, the print thus-obtained was allowed to stand at 100° C. and 100% RH for 14 hours to observe the performance of conserving the image quality. As a result, an excellent result was obtained because discoloration and migration were not observed.

EXAMPLE 2

A dye receiving layer the composition of which was arranged as follows was formed on the upper surface of the white coat layer of the sheet B according to Example 1. As a result, an image receiving sheet 2 was obtained. The thickness of the dye receiving layer was 3 μm.

| Composition of Dye Receiving Layer | |
|---|---|
| Polyester resin resin (Vylon 200 manufactured by Toyo Boseki) | 100 parts by weight |
| Toluene | 100 parts by weight |
| Ethyl acetate | 100 parts by weight |
| Methyl enthyl ketone | 100 parts by weight |
| Amino denatured silicone (KF-393 manufactured by Shin-Etsu Silicone) | 5 parts by weight |
| Dye solving agent [poly(oxyethylene.oxypropylene) glycol monoether: New Pole 50HB-260 manufactured by Sanyo Kasei] | 4 parts by weight |
| Adsorbent (hydrophobic fine powder silica: Aerosil R-976 manufactured by Nihon Aerosil) | 5 parts by weight |

The image receiving sheet thus-manufactured was used to perform printing similarly to the manner according to Example 1 to measure the black density. As a result, a density value of 2.21 was obtained. Furthermore, the performance of conserving the image quality was observed similarly to Example 1, resulting an excellent effect without discoloration and migration.

EXAMPLE 3

A dye receiving layer the composition of which was arranged as follows was formed on the white coat layer of the sheet B according to Example 1 before UV irradiation was performed. As a result, an image receiving sheet 3 was obtained. The thickness of the dye receiving layer was 5 μm.

| Composition of Dye Receiving Layer | |
|---|---|
| Chloriated polyester (Ebecryl 585 manufactured by Daisel UCB) | 100 parts by weight |
| Polymerization initiator (Darocure manufactured by Merk Japan) | 2 parts by weight |

-continued

| | |
|---|---|
| Releasing agent (Ebecryl 1360 manufactured by Daisel UCB) | 3 parts by weight |
| Organic agent for improving dye transfer density (polyoxyethylene sorbitan fatty acid ester: Ionet T-20C manufactured by Sanyo Kasei) | 10 parts by weight |
| Adsorbent (hydrophobic fine powder silica: Aerozil R-811 manufactured by Nihon Aerozil) | 5 parts by weight |

The image receiving sheet thus-manufactured was used to perform printing similarly to the manner according to Example 1 to measure the black density. As a result, a density value of 2.21 was obtained. Furthermore, the performance of conserving the image quality was observed similarly to Example 1, resulting an excellent effect without discoloration and migration.

EXAMPLE 4

A dye receiving layer the composition of which was arranged as follows was formed on the white coat layer of the sheet B according to Example 1. As a result, an image receiving sheet 4 was obtained. The thickness of the dye receiving layer was 3 μm.

| Composition of Dye Receiving Layer | |
|---|---|
| Polyester resin (Vylon 200 manufactured by Toyo Boseki) | 100 parts by weight |
| Toluene | 100 parts by weight |
| Ethyl acetate | 100 parts by weight |
| Methyl ethyl ketone | 100 parts by weight |
| Amino denatured silicone (KF-393 manufactured by Shin-Etsu Silicone) | 5 parts by weight |
| Dye solving agent (barium-zinc organic complex: Adbustab BZ-171J manufactured by Katsuta Kako) | 5 parts by weight |
| Adsorbent (hydrophobic fine powder silica: Aerosil R-812 manufactured by Nihon Aerosil | 10 parts by weight |

The image receiving sheet thus-manufactured was used to perform printing similarly to the manner according to Example 1 to measure the black density. As a result, a density value of 2.20 was obtained. Furthermore, the performance of conserving the image quality was observed similarly to Example 1, resulting an excellent effect without discoloration and migration.

EXAMPLE 5

A transparent polyester film the thickness of which was 100 μm was used to serve as the base and the dye receiving layer according to Example 1 was formed on the upper surface of the above-described film so that a transparent image receiving sheet was obtained. The thickness of the dye receiving layer was 3 μm.

The image receiving sheet thus-manufactured exhibited an excellent transparency. Then, printing was performed in a manner similar to that according to Example 1 to measure the black density. As a result, satisfactory density of the printed image was obtained such that the density of the black solid portion was 2.10. Furthermore, the performance of conserving the image quality was observed similarly to Example 1, resulting an excellent result to be obtained without discoloration and migration. Therefore, the image receiving sheet according to example can be used as sublimatin type thermal transfer OHP sheet because of its excellent dyeing facility and the performance of conserving the image quality.

COMPARATIVE EXAMPLE 1

A dye receiving layer the composition of which was arranged as follows was formed on the white coat layer of the sheet B according to Example 1. As a result, an image receiving sheet was obtained the thickness of the dye receiving layer was 3 μm.

| Composition of Dye Receiving Layer | |
|---|---|
| Water base polyester resin (Vylonal MD1200 manufactured by Toyo Boseki) | 200 parts by weight |
| Wetting agent | 4 parts by weight |
| Associative thickener | 10 parts by weight |
| Amino denatured silicone (KF-393 manufactured by Shin-Etsu Silicone) | 5 parts by weight |
| IPA | 300 parts by weight |
| Water | 100 parts by weight |

The image receiving sheet thus-manufactured was used to perform printing similarly to the manner according to Example 1 to measure the black density and observe the performance of conserving the image quality. As a result, an unsatisfactory black density of 1.80 was obtained, what is even worse, the performance of conserving the image quality was unsatisfactory such that discoloration and migration takes place.

COMPARATIVE EXAMPLE 2

A dye receiving layer the composition of which was arranged as follows was formed on the white coat layer of the sheet B according to Example 1. As a result, an image receiving sheet was obtained. The thickness of the dye receiving layer was 3 μm.

| Composition of Dye Receiving Layer | |
|---|---|
| Polyester resin (Vylon 200 manufactured by Toyo Boseki) | 100 parts by weight |
| Toluene | 100 parts by weight |
| Ethyl acetate | 100 parts by weight |
| Methyl ethyl ketone | 100 parts by weight |
| Amino denatured silicone | 5 parts by weight |
| Thick dye (New Pole 50HB-260 manufactured by Sanyo Kasei) | 4 parts by weight |

The image receiving sheet thus-manufactured was used to perform printing similarly to the manner according to Example 1 to measure the black density and observe the performance of conserving the image quality. As a result, although a satisfactory black density of 2.20 was obtained, the performance of conserving the image quality was unsatisfactory such that discoloration and migration takes place.

COMPARATIVE EXAMPLE 3

A dye receiving layer the composition of which was arranged as follows was formed on the white coat layer of the sheet B according to Example 1 before UV irradiation was performed. As a result, an image receiving sheet was obtained. The thickness of the dye receiving layer was 5 μm.

| Composition of Dye Receiving Layer | |
|---|---|
| Chlorinated polyester (Ebecryl 585 manufactured by Daisel UCB) | 100 parts by weight |
| Polymerization initiator (Darocure manufactured by Merck Japan) | 2 parts by weight |
| Releasing agent (Ebecryl 1360 manufactured by Daisel UCB) | 3 parts by weight |
| Adsorbent hydrophobic fine powder silica: | 5 parts by weight |

-continued

| |
|---|
| Aerosil R-811 manufactured by Nibon Aerosil) |

The image receiving sheet thus-manufactured was used to perform printing similarly to the manner according to Example 1 to measure the black density and observe the performance of conserving the image quality. As a result, although the performance of conserving the image quality was satisfactory, an unsatisfactory density of 1.70 was obtained.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A thermal sublimable dye transfer image receiving sheet having a dye receiving layer on the surface of a base thereof, wherein said dye receiving layer contains a resin and an organic agent selected from the group consisting of an acetylene glycol, an acetylene alcohol, poly(oxyethylene.oxypropylene) glycol.monoether, polyoxyethylene sorbitan fatty acid ester and a fatty acid metal salt for improving dye transfer density and an inorganic adsorbent.

2. A thermal sublimable dye transfer image receiving sheet according to claim 1, wherein said inorganic adsorbent is hydrophobic fine powder silica.

3. The sheet of claim 1 wherein said inorganic adsorbent has a weight that is 0.1 to 40% of the weight of said resin.

4. The sheet of claim 3 wherein the weight of said inorganic adsorbent is 0.5 to 20% of the weight of said resin.

5. The sheet of claim 1 wherein said organic agent has a weight that is 4 to 35% of the weight of said resin.

* * * * *